US009250594B2

(12) United States Patent
Herrmann et al.

(10) Patent No.: US 9,250,594 B2
(45) Date of Patent: Feb. 2, 2016

(54) SYSTEMS AND METHODS FOR IMPLEMENTING AN ASYNCHRONOUS BUFFERING MODULE WITH AN INTEGRATED REGISTRATION FUNCTION FOR INLINE PRINTING AN IMAGE FORMING SYSTEM

(71) Applicant: XEROX Corporation, Norwalk, CT (US)

(72) Inventors: Douglas K. Herrmann, Webster, NY (US); Mark S. Amico, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 17 days.

(21) Appl. No.: 14/188,614

(22) Filed: Feb. 24, 2014

(65) Prior Publication Data

US 2015/0241830 A1 Aug. 27, 2015

(51) Int. Cl.

| | |
|---|---|
| ***B65H 29/60*** | (2006.01) |
| ***G03G 15/00*** | (2006.01) |
| ***G03G 15/23*** | (2006.01) |

(52) U.S. Cl.

CPC ..... *G03G 15/5062* (2013.01); *B65H 29/60* (2013.01); *G03G 15/238* (2013.01); *B65H 2301/4454* (2013.01); *B65H 2301/4482* (2013.01)

(58) Field of Classification Search

CPC ..... B65H 2301/4213; B65H 2301/4482; B65H 2301/44822; B65H 2301/4455; B65H 2301/44552; B65H 2301/4454; B65H 2301/44512; B65H 5/34; B65H 29/60; G03G 15/238; B41J 13/0045; B41J 13/009

See application file for complete search history.

(56) References Cited

U.S. PATENT DOCUMENTS

| | | | | |
|---|---|---|---|---|
| 3,815,897 | A * | 6/1974 | Hoehl et al. | 271/9.13 |
| 6,124,561 | A * | 9/2000 | Luckhurst et al. | 209/583 |
| 6,910,689 | B2 * | 6/2005 | Carolan | 271/228 |
| 8,493,589 | B2 * | 7/2013 | Nakamura | 358/1.14 |
| 2010/0247194 | A1 * | 9/2010 | Suh | 399/367 |

* cited by examiner

*Primary Examiner* — Justin Olamit

(74) *Attorney, Agent, or Firm* — Ronald E. Prass, Jr.; Prass LLP

(57) ABSTRACT

A system and method are provided for implementing an asynchronous buffering module and/or scheme employing an integrated registration function, particularly for in-line printing in an image forming system. Multiple simplex marking engines are arranged in series and provided with a mechanism that includes an asynchronous buffering module with the capacity to modify the timing of individual sheets of image receiving media passing between the in-line marking engines. The buffering module is augmented with an integrated registration function for the in-line duplex printing. The combined mechanism provides a capacity between the multiple marking engines to effect timing synchronization and re-registration for the sheets exiting the first serial marking engine allowing them to be properly timed and registered for feeding to the second serial marking engine. An asynchronous nature of the combination of media marking engines is synchronized in the feed of the sheets between the media marking engines.

15 Claims, 7 Drawing Sheets

SYSTEMS AND METHODS FOR IMPLEMENTING AN ASYNCHRONOUS BUFFERING MODULE WITH AN INTEGRATED REGISTRATION FUNCTION FOR INLINE PRINTING AN IMAGE FORMING SYSTEM

BACKGROUND

1. Field of Disclosed Subject Matter

This disclosure relates to systems and methods for implementing an asynchronous buffering module and/or scheme employing an integrated registration function, particularly for in-line printing in an image forming system.

2. Related Art

Most modern, sometimes complex, image forming systems include one or more techniques for image forming on both sides of an image receiving media substrate. These two-sided or duplex printing functions typically include the input of a sheet of image receiving media from an input tray and translation of the sheet of image receiving media, via a first transport path, through a media marking engine that is configured to deposit a marking material on a first surface of the sheet of image receiving media. The image may then be fused, or otherwise fixed, on the first surface of the sheet of image receiving media. With a duplex mode selected in the image forming system, the sheet of image receiving media is not output to an output tray. Rather, the sheet of image receiving media is translated, via a second (duplex) transport path, to a beginning of the first transport path, the second (duplex) transport path including a sheet inversion function or unit that results in the sheet of image receiving media being reintroduced, via the first transport path, through the media marking engine again such that the marking material is deposited on a second surface of the sheet of image receiving media. The sheet of image receiving media may then be passed to, or through, an image fusing/fixing unit to finally finish the images on the first and second surfaces of the sheet of image receiving media, prior to passing the sheet of image receiving media to a post-processing device, or to an output tray.

Regardless of the simplicity or complexity of the two-sided or duplex printing operations, duplexing operations typically significantly reduce the page-per-minute (ppm) throughput of the image forming system. The manipulations of the sheets of image receiving media to cause them to appropriately pass through the single media marking engine twice before ultimately being passed downstream in the process direction account for a significant percentage of the reductions in throughput.

Image forming system designers and manufacturers, driven by the competitive nature of the business and in an effort to meet ever increasing production requirements levied by their customers, have sought solutions to limit the reductions in image receiving media throughput in their devices, particularly in a duplex printing mode. One solution to increase the throughput in duplex image forming operations in an image forming system that is to place two marking engines, each operating in a single-side printing or simplex mode, in series. FIG. 1 illustrates a block diagram of an exemplary configuration of such an image forming system 100. As shown in FIG. 1, an image receiving media input source 110 such as, for example, an input tray is provided. Sheets of image receiving media are pulled from the media input source 110 to begin a duplex image forming operation in the exemplary image forming system 100. A first media marking engine 120 forms, and potentially fixes, an image on a first side of the sheet of image receiving media. A media inversion device (sheet inverter) 130 is located between the first media marking engine 120 and the second media marking engine 140 to invert the sheet of image receiving media. The second media marking engine 140 then forms, and potentially fixes, an image on the second side of the sheet of image receiving media. The sheet of image receiving media may then be passed to a media post-processing device 150 and/or to a media output receptacle 160, such as an output tray.

SUMMARY OF DISCLOSED EMBODIMENTS

In duplex image forming configurations including serial simplex media marking engines, as described above and as generally depicted in FIG. 1, an issue arises with the placing of the two media marking engines in line. The issue arises from the print cycles of the individual media marking engines being generally asynchronous. As a result the serial simplex media marking engine image forming system, as a whole, may generally be unable to pass the sheets of image receiving media from the first media marking engine 120 to the second media marking engine 140 due to variations, for example, in sheet timing caused by each of the two media marking engines and their particular individual internal system timing.

Separately, printing systems, media marking engines, and other, including third party, media handling systems require that input registration characteristics of the sheets of image receiving media meet specific criteria. Generally, an output of one media marking engine does not necessarily provide the registration performance to allow a downstream media marking engine to re-register the sheet of image receiving media substrate to proper specifications.

Further compounding the registration dilemma is that the downstream media marking engine, if not identical, i.e., a third party system, may have different registration standards. For example, a first media marking engine may be edge registered while a second media marking engine may be center registered, or vice versa.

Media marking engines, as those devices may be referenced throughout this disclosure, are not intended to be devices that are restricted to employment of any particular media marking materials, e.g., inks, toners and the like, or to any particular delivery mechanisms for those media marking materials, including but not limited to, xerographic image forming, inkjet delivery, laser marking, lithographic ink delivery or the like. Further, the media marking engines described in this disclosure may include initial image finishing components, e.g., fuser modules for fusing and/or fixing the delivered media marking materials on the surfaces of the image receiving media by heat, pressure, or a combination of the two. It should be recognized, however, that the initial image finishing components may be separate, stand-alone devices or may be incorporated as portions of other media post-processing devices.

It would be advantageous in view of the above-noted circumstances arising from image forming and fixing operations in image forming systems employing multiple in-line simplex media marking engines arranged in series to implement a mechanism or scheme that may include an asynchronous buffering module with the capacity to modify the timing of individual sheets of image receiving media as they pass between the in-line simplex media marking devices. It may be further advantageous to augment such a buffering module with an integrated registration function for the in-line duplex printing. Such a combined mechanism or scheme may provide a capacity between the multiple media marking engines to effect timing synchronization and re-registration for the sheets of image receiving media exiting the first serial media marking engine allowing them to be properly timed and registered, as appropriate, for feeding to the second serial media marking engine.

Exemplary embodiments of the systems and methods according to this disclosure may implement a separate module that is configured of a plurality of separate buffering trays that may provide a capacity for handling the sheets of image receiving media output by a first media marking device and buffering those sheets of image receiving media in a manner that times the outputs of the first media marking device to meet the required input timing for the second media marking device. Such a buffering module may allow each of the individual media marking devices to conduct image forming operations at simplex speeds, thereby resulting in increased coordinated and unimpeded duplex image forming operation throughput.

Exemplary embodiments may divert individual sheets of image receiving media to one of a plurality of buffering slots and then time their release from the buffering slots to match an optimal timing for input of the individual sheets of image receiving media to the downstream media marking device. In this manner, timing discrepancies between the two in-line media marking devices may be reduced, or otherwise substantially eliminated.

Exemplary embodiments may take an asynchronous combination of media marking devices and synchronize the feed of sheets of image receiving media between the media marking devices.

Exemplary embodiments may include a selectable mode in a buffering module whereby, when the image forming system is operated in a simplex mode, sheets of image receiving media may pass straight through the buffering module without being diverted into one of a plurality of buffering slots.

Exemplary embodiments may augment the buffering and/or timing modification capacity of the disclosed buffering module by combining a registration unit with buffering bins to provide appropriate registration of sheets of image receiving media passing therethrough to make the registration of the sheets compatible with the input requirements of the downstream media marking device.

In embodiments, an integral or connected registration unit may take the form of a translating electronic registration or TELER system. The TELER registration system may include a moveable top edge registration sensor or CCD, and be capable of, for example, taking a center registered sheet and re-registering the sheet to the edge as an edge registered sheet, or vice versa, to make compatible both an input and output to the specific requirements of the individual media marking devices with regard to being either edge or center registered systems.

These and other features, and advantages, of the disclosed systems and methods are described in, or apparent from, the following detailed description of various exemplary embodiments.

BRIEF DESCRIPTION OF THE DRAWINGS

Various exemplary embodiments of the disclosed systems and methods for implementing an asynchronous buffering module and/or scheme employing an integrated registration function, particularly for in-line duplex printing in an image forming system, will be described, in detail, with reference to the following drawings, in which.

DETAILED DESCRIPTION OF THE DISCLOSED EMBODIMENTS

The systems and methods for implementing an asynchronous buffering module and/or scheme employing an integrated registration function, particularly for in-line printing in an image forming system according to this disclosure will generally refer to this specific utility or function for those systems and methods. Exemplary embodiments described and depicted in this disclosure should not be interpreted as being specifically limited to any particular configuration of the described elements, or as being specifically directed to any particular intended use, including any particular functioning or operation of a plurality of in-line single-side or simplex media marking devices in an image forming system. Any advantageous combination of features, schemes, techniques and/or processes that may employ a particularly-configured structure of a module for modifying a timing of individual sheets of image receiving media passing between the plurality of in-line single-side simplex media marking devices, including implementing a re-registration function to render compatible an output registration from the first media marking device to an input registration for the second media marking device is contemplated as being encompassed by this disclosure.

Specific reference to, for example, various configurations of image forming systems, individual media marking devices, and other component devices within those systems, including sheet inverters, post-processors and the like, as those concepts and related terms are captured and used throughout this disclosure, should not be considered as limiting those concepts or terms to any particular configuration of the respective devices, the overall system or the individually-described elements. The subject matter of this disclosure is intended to broadly encompass systems, devices, schemes and elements that may involve image forming and finishing operations as those operations would be familiar to those of skill in the art. The disclosed concepts are particularly adapted to implementing timing adjustment for the feeding of sheets of image receiving media from a first simplex media marking device to a second downstream in-line simplex media marking device, and for supplementing the timing adjustment with appropriate re-registration of the sheets of image forming media as necessary to facilitate ease of operations for second-side printing on the sheets of image receiving media in the second downstream in-line simplex media marking device.

Figure 1:
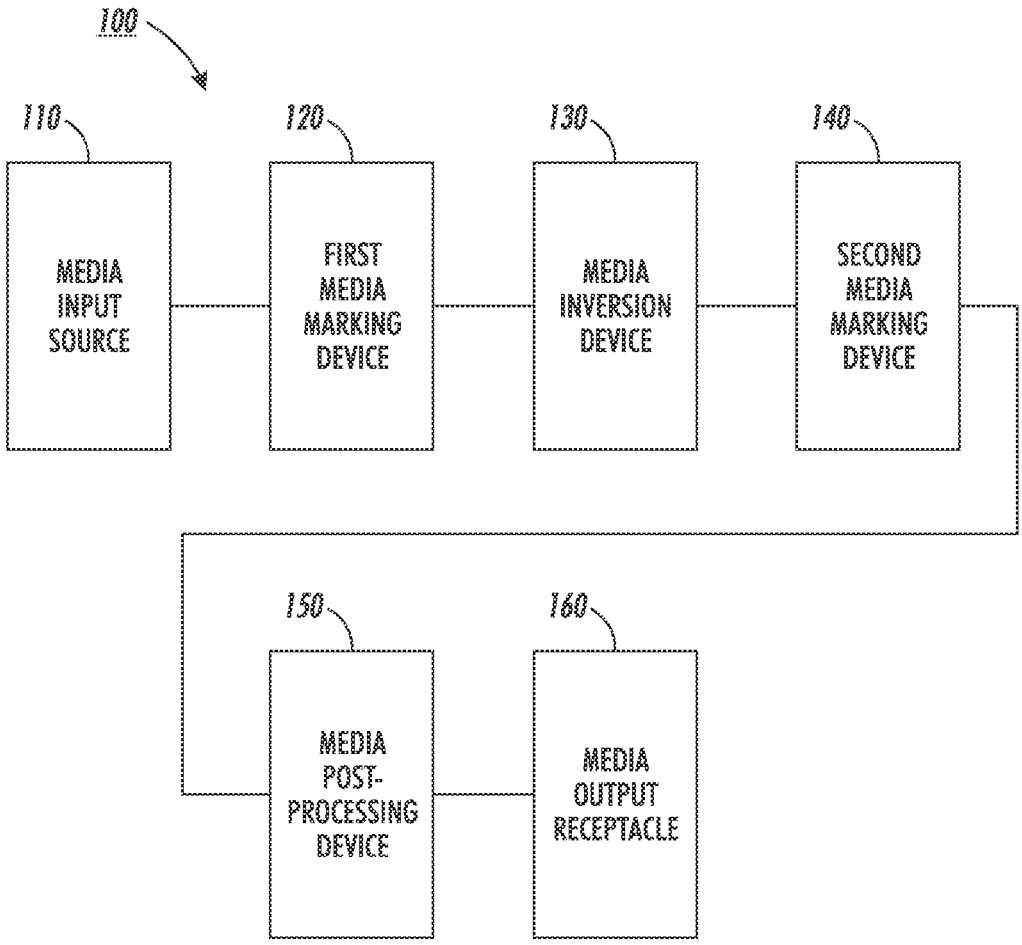
FIG. 1 Related Art
FIG. 1 illustrates a block diagram of a general configuration an exemplary image forming system that employs two in-line media marking devices with a sheet inverter disposed between them to perform duplex image forming operations in the image forming system.
Figure 2:
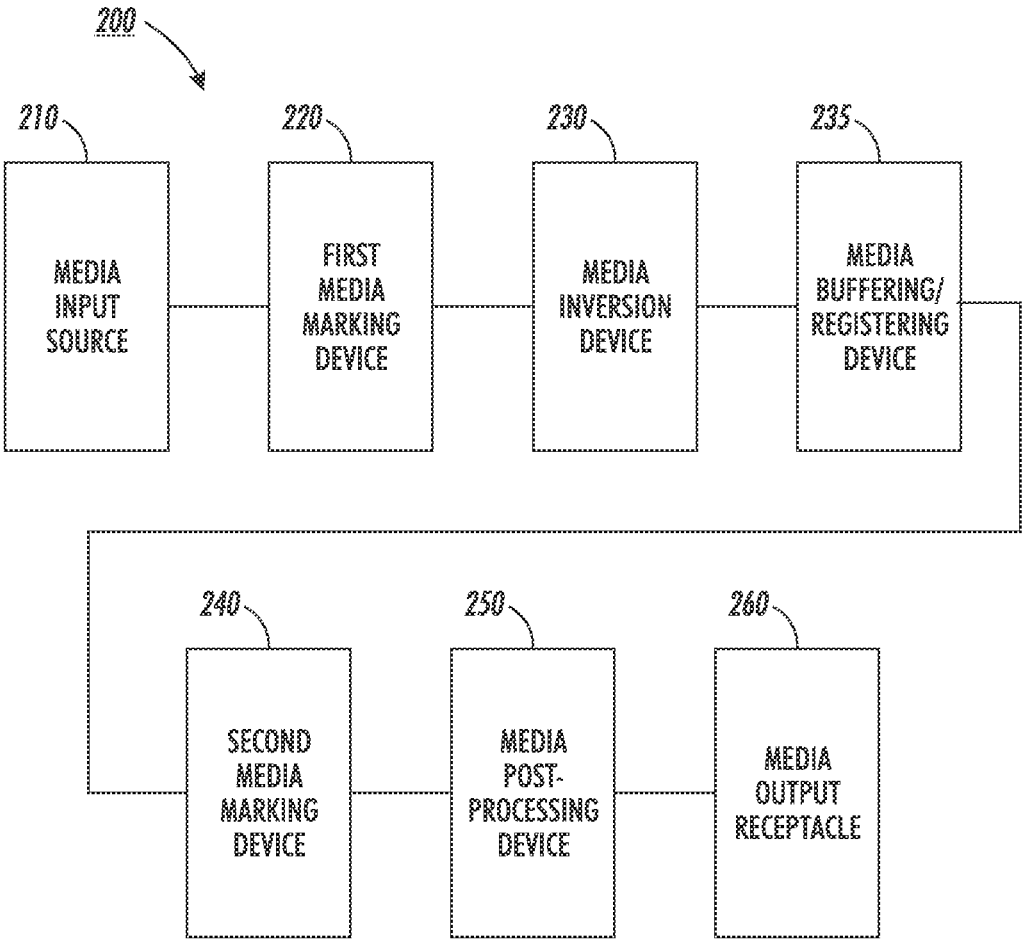
FIG. 2 illustrates a block diagram of an exemplary embodiment of an image forming system including a media buffering and/or registration device according to this disclosure.

FIG. 2 illustrates a block diagram of an exemplary embodiment of an image forming system 200 including a media buffering and/or registration device 235 according to this disclosure. Similar to the general configuration shown in FIG. 1, the exemplary system 200 shown in FIG. 2 includes an image receiving media input source 210, a first media marking device 220, a media inversion device 230, a second media marking device 240, a media post-processing device 250, and a media output receptacle 260. Where the exemplary system 200 shown in FIG. 2 differs from that shown in FIG. 1 is with the inclusion of a media buffering/registering device 235 positioned generally between the first media marking device 220 and the second media marking device 240. An exemplary embodiment of such a media buffering/registering device 235 will be described in greater detail below with reference to at least FIGS. 3 and 4.

Figure 3:
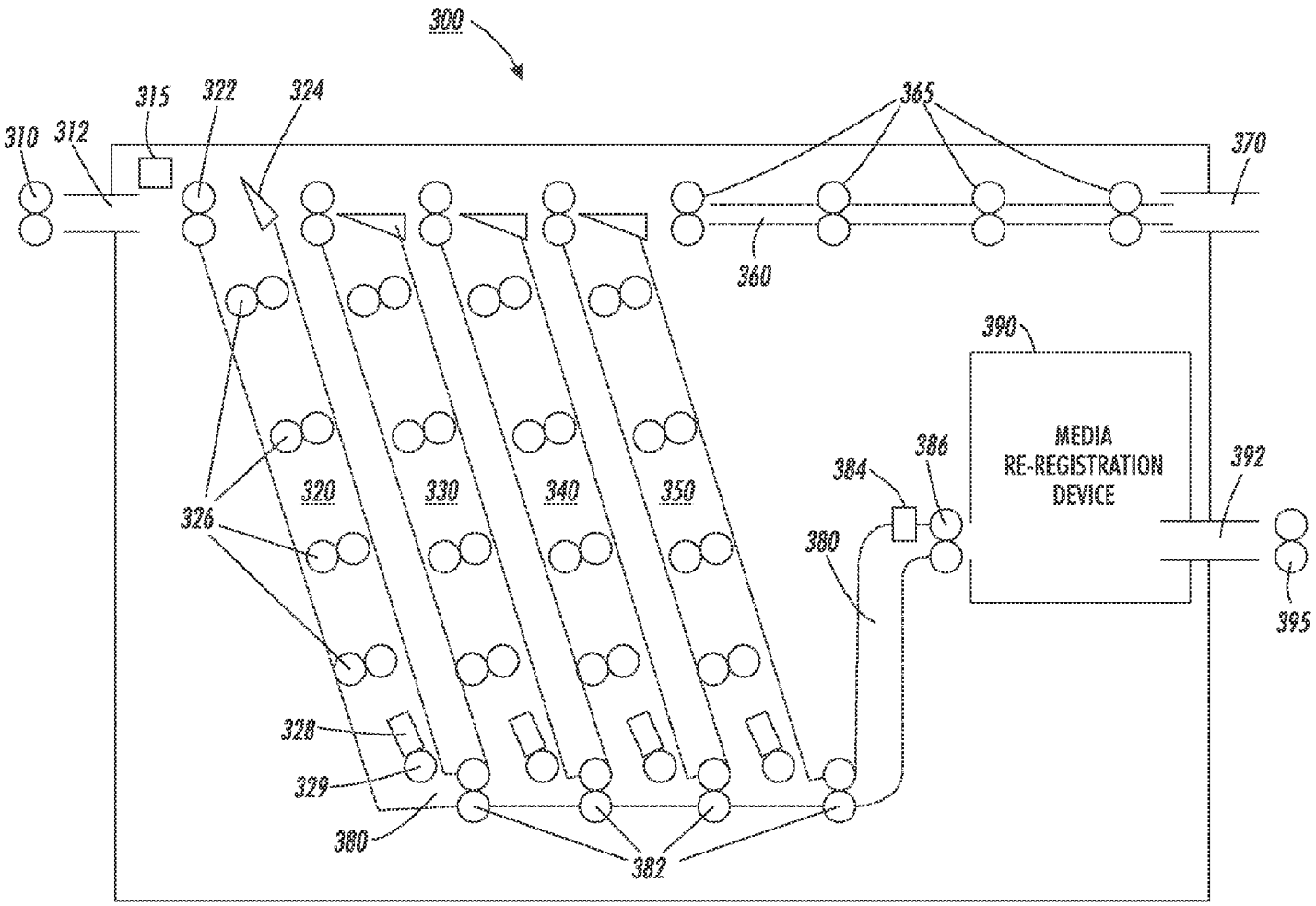
FIG. 3 illustrates a detailed schematic representation of an exemplary media buffering and/or registration device according to this disclosure.

FIG. 3 illustrates a detailed schematic representation of an exemplary media buffering and/or registration device 300 according to this disclosure. As shown in FIG. 3, the exemplary device 300 may accept individual sheets of image receiving media from an upstream single-side simplex media marking device (see FIG. 2) via, for example, an exit nip 310 in the upstream single-side simplex media marking device. The individual sheets of image receiving media may enter the exemplary device 300 via a media input portal 312. At this point in their transport path, individual sheets of image receiving media may be imaged by one or more input portal or entrance sensors 315 to detect at least a leading edge and a trailing edge of each sheet of image receiving media substrate for timing purposes.

A plurality of similarly-configured buffering or timing control passages (referred to alternatively as bins, slots, portals or trays) 320,330,340,350 may be provided. Each of the plurality of timing control passages 320,330,340,350 may include a media transport nip 322 and timing control passage entrance gate or diverter 324 that is movable between two positions. The two positions for the timing control passage entrance gate(s) or diverter(s) 324 may include a first position that diverts the sheet of image receiving media into a respective one of the timing control passages 320,330,340,350, and a second position that allows the sheet of image receiving media to bypass respective ones of the timing control passages 320,330,340,350.

In instances where, for example, the image forming system with which the exemplary device 300 is associated recognizes that a commanded image forming operation is a single-side simplex image forming operation, each of the entrance gates or diverters may be commanded to the second position. By positioning each of the entrance gates or diverters to the second position, the sheets of image receiving media substrates having been marked on a first surface by the upstream single-side simplex media marking device, may be passed along to a simplex transport path 360. The simplex path 360 may include a series of simplex transport path nips 365 for transporting the sheets of image receiving media to a first (simplex) outlet portal 370. In this manner, the sheets of image receiving media may be transported downstream in a process direction via a transport path that bypasses a second downstream single-side simplex media marking device (see FIG. 2).

In instances where the image forming system with which the exemplary device 300 is associated recognizes that a commanded image forming operation is a two-sided duplex image forming operation, one of the entrance gates or diverters associated with a currently unoccupied one of the timing control passages 320,330,340,350 may be commanded to the first position thereby diverting the sheet of image receiving media into the one of the timing control passages 320,330,340,350. The sheet of image receiving media may be transported downward into the one of the timing control passages 320,330,340,350 through a series of timing control passage nips 326. A presence of a sheet in the one of the timing control passages 320,330,340,350 may be sensed by one or more timing control passage media sensors 328. A signal may be generated by the timing control passage media sensor 328 to communicate to the second downstream single-side simplex media marking device that a sheet of image receiving media is held in the one of the timing control passages 320,330,340,350 awaiting release. In this manner, the sheets of image receiving media may be buffered in a manner that controls their timing before being passed via a timing control output roller 329 into a timing control exit path 380 for further transport. The timing control exit path 380 may include a series of timing control exit path nips 382 for transporting the sheets of image receiving media in a downstream direction.

The timing control exit path 380 may, for example, direct the sheets of image receiving media downstream in a process direction past one or more sensors, including a registration process sensor 384 in a vicinity of registration nip 386 leading to an entrance to a media re-registration device 390. More detail of an exemplary media re-registration device will be provided below with reference to FIG. 4.

Ultimately, a properly timed and properly registered sheet of image receiving media substrate may be directed to a second (duplex) outlet portal 392. In this manner, the sheets of image receiving media may be transported downstream in a process direction via, for example, one or more additional transport nips 395 to the second downstream single-side simplex media marking device (see FIG. 2). Those of skill in the art recognize that a sheet inverter will invert each sheet of image receiving media either upstream or downstream of the exemplary device 300 in order that the second surface of the sheet of image receiving media is properly presented to compete the duplex image forming operation with the second downstream single-side simplex media marking device.

As described, the exemplary device 300 is provided as a separate module that is configured to include of a plurality of buffering trays capable of handling an output of the first upstream single-side simplex media marking device, and buffering that output such that it is then timed to meet the timing requirements/constraints of the second downstream single-side simplex media marking device. This allows each of the separate media marking devices to operate efficiently at simplex speeds, thereby resulting in increased throughput for the image forming system with which the exemplary device 300 is associated when conducting duplex image forming operations.

By diverting the sheets of image receiving media individually to one of the plurality of timing control passages 320, 330,340,350 for duplex image forming operations, their release to match the second downstream single-side simplex media marking device input, timing discrepancies between the two single-side simplex media marking devices can be substantially eliminated. This takes the asynchronous nature of the combination of the two single-side simplex media marking devices and synchronizes the sheet of image receiving media feed between them.

Figure 4:
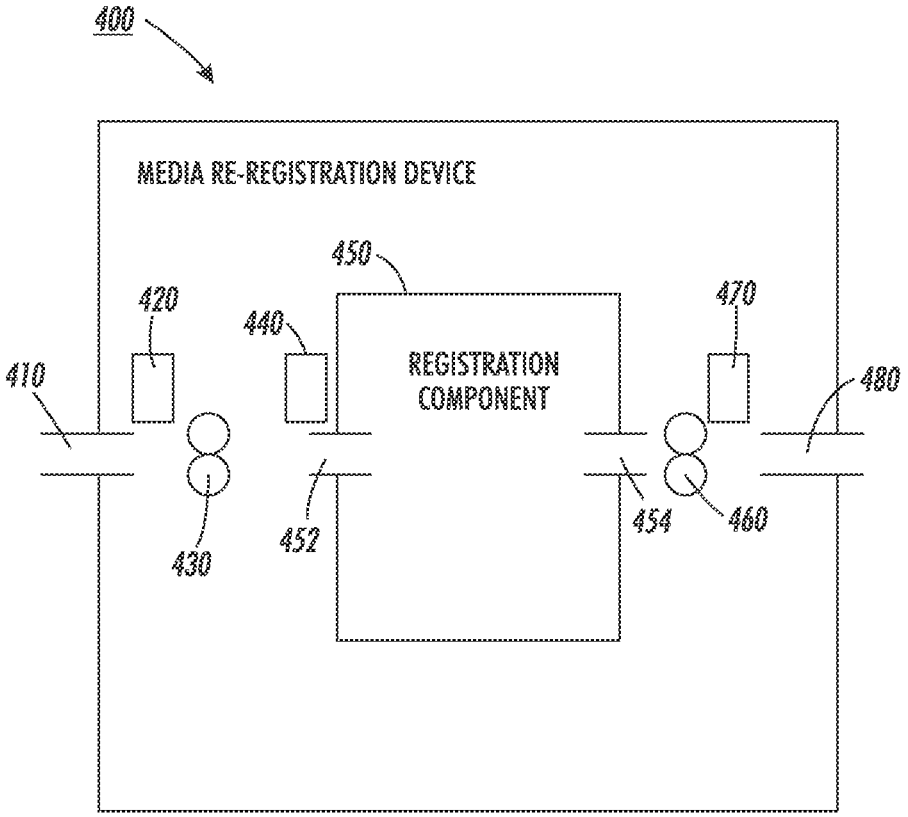
FIG. 4 illustrates a detailed schematic representation of an exemplary integral media registration/re-registration device which may be included as a component of the exemplary media buffering and/or registration device shown in FIG. 3.

FIG. 4 illustrates a detailed schematic representation of an exemplary integral media registration/re-registration device 400, which may be included as a component of the exemplary media buffering and/or registration device shown in FIG. 3.

As shown in FIG. 4, an entrance portal 410 may be provided to facilitate input of sheets of image receiving media substrate to the media re-registration device 400. The sheet of image receiving media substrate may then be transported past a registration process sensor 420, through a registration drive nip 430, past a registration leading edge sensor 440 and into a registration component 450 via a registration component input 452. Combining a media re-registration device 400 with the timing control passages shown in FIG. 3 may provide required registration and/or re-registration needed for ensuring precise image forming operations in the second downstream single-side simplex media marking device.

The registration component 450 may be comprised of any commonly-known device for facilitating registration of individual documents. One such common device known in the art is typically referred to as a TELER system. A TELER system typically provides a method of registering copy paper or documents. The TELER system generally includes three optical sensors, a pair of coaxial independently driven drive rolls, a carriage with a linear drive on which paper drive rolls are mounted, and a microprocessor controller. A sheet of image receiving media is driven into the nip rolls and moved through the paper path for placement and fusing of an image thereon. The speed of both nip rolls may be controlled to effect skew alignment and longitudinal registration. The nip rollers may generally be mounted on a carriage movable transversely with respect to the feed path. A sensor system may control positioning of the carriage to achieve the desired top edge or a lateral positioning of the sheet. Independent control of nip roll drive and carriage translation provides simultaneous alignment in lateral and longitudinal directions. A TELER system of this type is disclosed in U.S. Pat. No. 5,094,442 to Kamprath et al., issued Mar. 10, 1992, and discussed at some length in U.S. Pat. No. 5,794,176 to William D. Milillo, issued Aug. 11, 1998, and U.S. Pat. No. 6,910,689 to Kevin M. Carolan, issued Jun. 28, 2005. These patents are co-owned by the Assignee of this application, and the contents of their disclosures are hereby incorporated by reference herein in their entireties.

By incorporating a TELER system with a moveable top edge registration sensor, for example, as the media re-registration device 400, the TELER system can take a center registered sheet and register it to the edge, or an edge registered sheet and register it to the center making both the input and output compatible with edge and center registered systems. The time controlled and registered sheet of image receiving media may then be passed out of the media re-registration device via an internal output port 454, an outlet drive nip 460, one or more sensors 470 for confirming registration of the sheet of image receiving media and then out of the media re-registration device 400 via an outlet port 480 for transport to the second downstream single-side simplex media marking device.

Inclusion of a buffering and registration module, generally configured as described above, responds to a need in in-line print systems by providing an ability to match the print timing and, in some cases, registration of the first simplex media marking device to that of the second simplex media marking device facilitating selection for the media marking devices to work either independently or coupled. The disclosed buffering and registration module thus constitutes a device that, in essence, performs as another stacker to the first media marking device, while performing like a feeder module to the second media marking device. The internal buffering capability of the disclosed buffering and registration module may actively orchestrate media flow between both media marking devices and eliminate device to device synchronization in a coupled mode. The included registration function may ensure that any output registration issues from the upstream media marking device are corrected prior to feeding the downstream media marking device.

Typically, the disclosed buffering and registration module may be required to host from three to five sheets of image receiving media to enable the system to function, but the system may be expanded to larger numbers of bins to accommodate larger buffering capacity. The disclosed buffering and registration module functions as a sheet delaying and registration station and not a module where sheet re-acquisition is required. Because the sheets of image receiving media are never compiled, they do not require singulation to feed to the downstream media marking device. By not requiring any sheet re-acquisition, the overall module will have a high degree of reliability. The added function of registration corrects for any accumulated registration error from the upstream media marking device. This function may be particularly relevant when dealing with larger media lengths, where incoming skew to the downstream media marking device may be limited and must be controlled to a tight specification.

Figure 5:
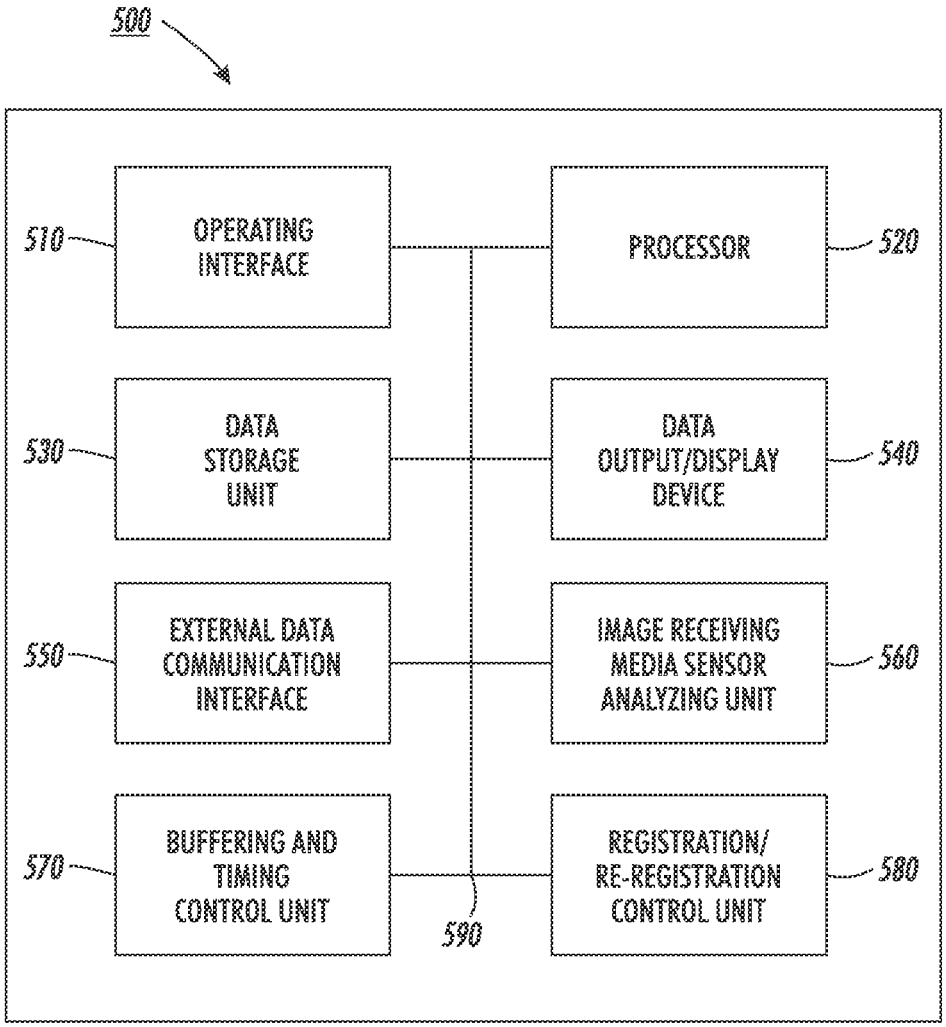
FIG. 5 illustrates a block diagram of a control system for controlling a media buffering and/or registration device according to this disclosure.

FIG. 5 illustrates a block diagram of an exemplary control system 500 for controlling a media buffering and/or registration device according to this disclosure. The exemplary control system 500 shown in FIG. 5 may be implemented as a unit integral to a complex image forming system, or it may be implemented as a separate unit remote from, and in communication with, the image forming system.

The exemplary control system 500 may include an operating interface 510 by which a user may communicate with the exemplary control system 500 for directing at least a mode of operation of a media buffering and/or registration device in the image forming system. Control inputs received in the exemplary control system 500 via the operating interface 510 may be processed and communicated to the image forming system via one or more of a buffering and timing control unit 570 or a registration/re-registration unit 580. The operating interface 510 may be a locally accessible user interface associated with the image forming system, which may be configured as one or more conventional mechanisms common to control devices and/or computing devices that may permit a user to input information to the exemplary control system 500. The operating interface 510 may be a part of a function of a graphical user interface (GUI) mounted on, integral to, or associated with, the image forming system with which the exemplary control system 500 is associated to direct processing or post-processing image receiving media transport in the associated image forming system.

The exemplary control system 500 may include one or more local processors 520 for individually operating the exemplary control system 500. The processor 520 may reference image forming operation and/or individual media marking device characteristics that may stored, for example, in one or more data storage devices 530. Processor(s) 520 may include at least one conventional processor or microprocessor that interprets and executes instructions to direct specific functioning of the exemplary control system 500 and an associated image forming system for processing and/or post-processing of image formed documents.

The exemplary control system 500 may include one or more data storage devices 530. Such data storage device(s) 530 may be used to store data or operating programs to be used by the exemplary control system 500, and specifically the processor(s) 520 in carrying into operation the disclosed functions. Data storage device(s) 530 may be used to store information regarding the image forming operation carried out by the image forming system as well as specific timing and/or registration requirements for each of the multiple image marking devices in the image forming system. Stored schemes and operating parameters may be referenced to control aspects of the image forming functions as well as determining optimum timing and/or registration conditions to be effected by the media buffering and/or registration device controlled by the exemplary control system 500.

The data storage device(s) 530 may include a random access memory (RAM) or another type of dynamic storage device that is capable of storing updatable database information, and for separately storing instructions for execution of system operations by, for example, processor(s) 520. Data storage device(s) 530 may also include a read-only memory (ROM), which may include a conventional ROM device or another type of static storage device that stores static information and instructions for processor(s) 520. Further, the data storage device(s) 530 may be integral to the exemplary control system 500, or may be provided external to, and in wired or wireless communication with, the exemplary control system 500.

The exemplary control system 500 may include at least one data output/display device 540, which may be configured as one or more conventional mechanisms that output information to a user, including, but not limited to, a display screen on a GUI of the image forming system with which the exemplary control system 500 may be associated. The data output/display device 540 may be used to indicate operating conditions or modes of the media buffering and/or registration device.

Where appropriate, the exemplary control system 500 may include at least one external data communication interface 550 by which the exemplary control system 500 may communicate with the image forming system for effecting image forming operations and post-processing operations including control of the media buffering and/or registration device.

An image receiving media sensor analyzing unit 560 may be provided as a standalone device or as a portion, and/or as a function, of the processor 520 in communication with the at least one data storage device 530. The image receiving media sensor analyzing unit 560 may collect and process information from one or more sensors positioned throughout the media buffering and/or registration device to establish parameters for operating control functions to carry into effect by the media buffering and/or registration device generally as described above.

The exemplary control system 500 may include a buffering and timing control unit 570 by which signals are generated to operate the media buffering and/or registration device, in the manner described above, to execute timing control of the sheets of image receiving media passing therethrough for facilitating precise duplex image forming operations in an image forming system. Signals generated by the buffering and timing control unit 570 may be based on a detection and isolation of a position of individual sheets of image receiving media passing through the media buffering and/or registration device. Signals generated by the buffering and timing control unit 570 may also be sent to the second downstream single-side simplex media marking device to identify that a sheet of image receiving media is available for release to the downstream single-side simplex media marking device. Return signals may be received by the buffering and timing control unit 570 from the second downstream single-side simplex media marking device to cause an available sheet of image receiving media to be released for processing in the downstream single-side simplex media marking device according to timing controlled by the media marking device.

The exemplary control system 500 may include a registration/re-registration control unit 580 by which signals are generated to operate the media buffering and/or registration device in the manner described above to direct registration of a sheet of image receiving media passing therethrough in order to make the physical registration of the sheet of image receiving media comport with requirements of the second downstream single-side simplex media marking device by reference to parameters of that media marking device that may be recovered from the media marking device itself, or that may be stored, for example, in one or more data storage devices 530.

All of the various components of the exemplary control system 500, as depicted in FIG. 5, may be connected internally, and potentially to a processing device such as, for example, a media buffering and/or registration device in an image forming system, by one or more data/control busses 590. These data/control busses 590 may provide wired or wireless communication between the various components of the exemplary control system 500, whether all of those components are housed integrally in, or are otherwise external and connected to, other components of an image forming system with which the exemplary control system 500 may be associated.

It should be appreciated that, although depicted in FIG. 5 as an essentially integral unit, the various disclosed elements of the exemplary control system 500 may be arranged in any combination of sub-systems as individual components or combinations of components, integral to a single unit, or external to, and in wired or wireless communication with, the single unit of the exemplary control system 500. In other words, no specific configuration as an integral unit or as a support unit is to be implied by the depiction in FIG. 5. Further, although depicted as individual units for ease of understanding of the details provided in this disclosure regarding the exemplary control system 500, it should be understood that the described functions of any of the individually-depicted components may be undertaken, for example, by one or more processors 520 connected to, and in communication with, one or more data storage device(s) 530, all of which may support operations in the associated image forming system.

Figure 6:
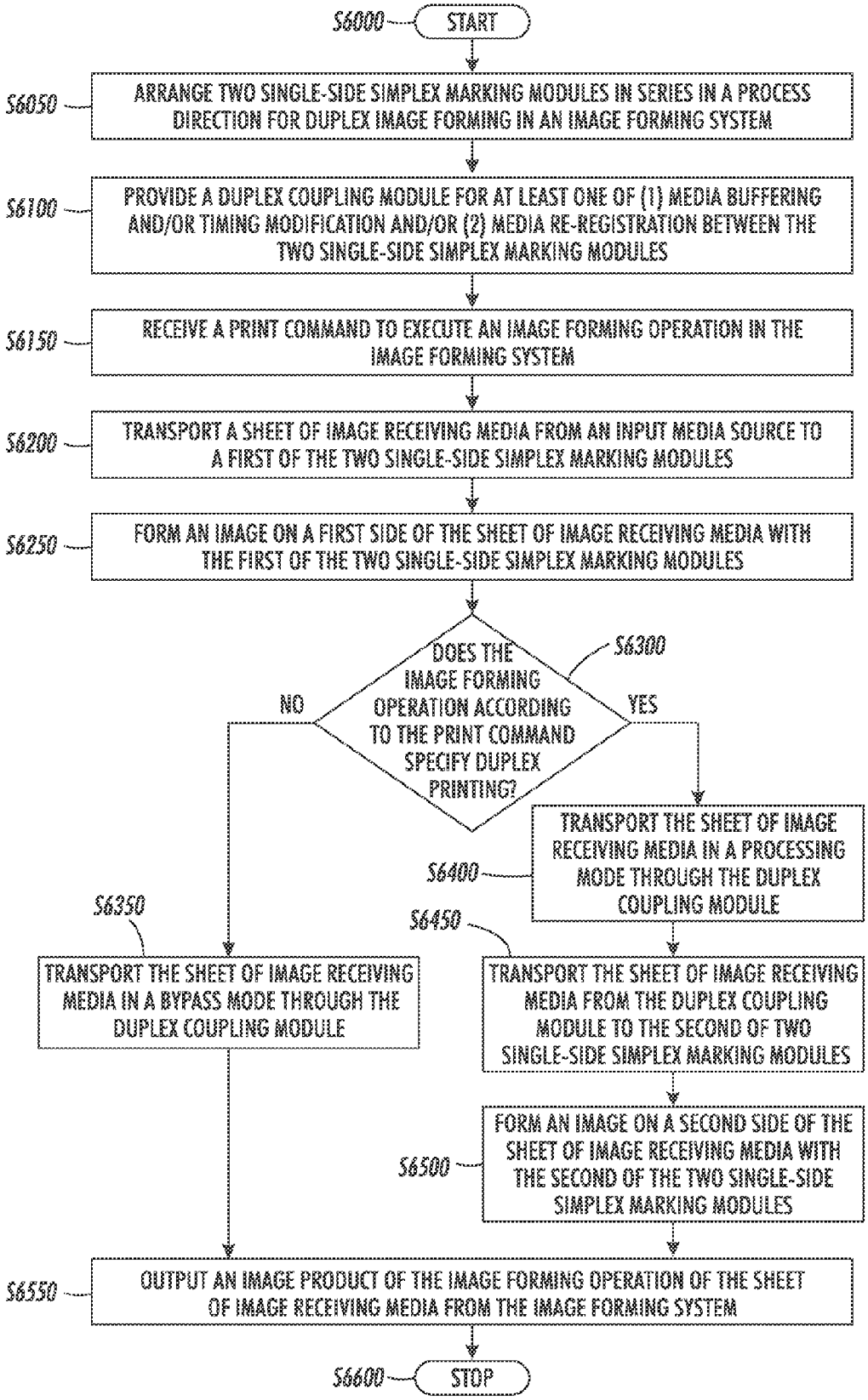
FIG. 6 illustrates a flowchart of an exemplary method for implementing image forming operations including selectable in-line media processing, which may include media buffering and/or re-registration, according to this disclosure.

The disclosed embodiments may include an exemplary method for implementing image forming operations including selectable in-line media processing, which may include media buffering and/or re-registration, in an image forming system. FIG. 6 illustrates a flowchart of such an exemplary method. As shown in FIG. 6, operation of the method commences at Step S6000 and proceeds to Step S6050.

In Step S6050, two single-side simplex media marking modules may be arranged in series in a process direction for duplex image forming in an image forming system. Operation of the method proceeds to Step S6100.

In Step S6100, a duplex coupling module for at least one of (1) media buffering and/or timing modification, and (2) media re-registration may be provided between the two single-side simplex media marking modules in the image forming system. Operation of the method proceeds to Step S6150.

In Step S6150, a print command may be received by the image forming system for execution of an image forming operation in the image forming system. Operation of the method proceeds to Step S6200.

In Step S6200, a sheet of image receiving media may be transported from an input media source to a first of the two single-side simplex media marking modules in the image forming system. Operation of the method proceeds to Step S6250.

In Step S6250, an image may be formed on a first side of the sheet of image receiving media with the first of the two single-side simplex media marking modules in the image forming system. Operation of the method proceeds to Step S6300.

Step S6300 is a determination step. In Step S6300, a determination is made regarding whether the image forming operation undertaken in the image forming system according to the print command is a duplex image forming operation.

If in Step S6300, it is determined that the image forming operation undertaken in the image forming system according to the print command is not a duplex image forming operation, operation of the method proceeds to Step S6350.

In Step S6350, the sheet of image receiving media may be transported in a bypass mode through the duplex coupling module exiting the duplex coupling module via a first output portal that in turn may direct the sheet of image receiving media to bypass a second of the two single-side simplex media marking modules in the image forming system. Operation of the method proceeds to Step S6550.

If in Step S6300, it is determined that the image forming operation undertaken in the image forming system according to the print command is a duplex image forming operation, operation of the method proceeds to Step S6400.

Figure 7:
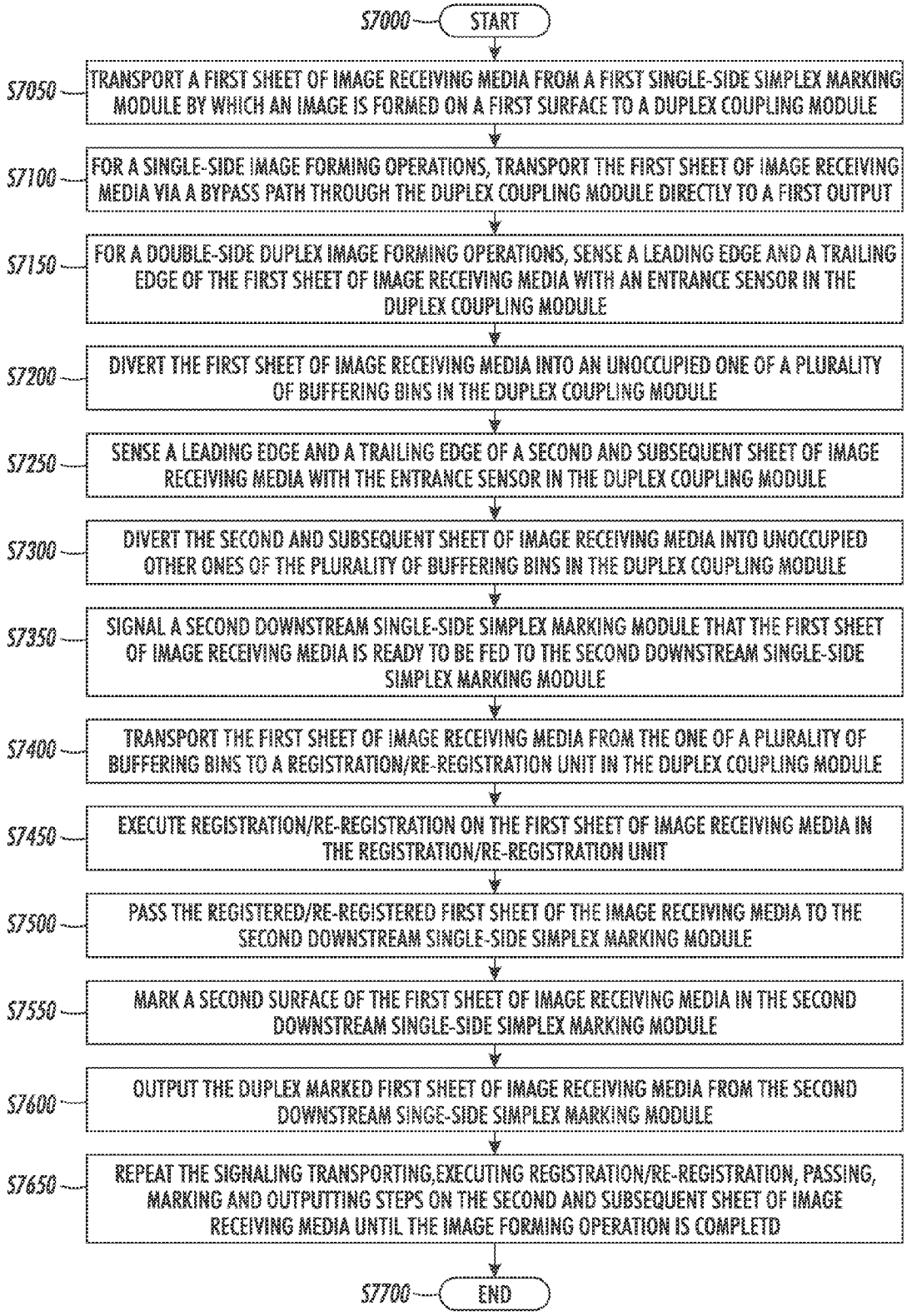
FIG. 7 illustrates a flowchart of an exemplary method for implementing selectable image receiving media buffering and/or re-registration according to this disclosure.

In Step S6400, the sheet of image receiving media may be transported through the duplex coupling module in a processing mode, which will be described in further detail below with reference to the method depicted in FIG. 7. Operation of the method proceeds to Step S6450.

In Step S6450, the sheet of image receiving media substrate may be transported from the duplex coupling module to the second of the two single-side simplex media marking modules. Operation method proceeds to Step S6500.

In Step S6500, an image may be formed on a second side of the sheet of image receiving media in the second of the two single-side simplex media marking modules. Operation of the method proceeds to Step S6550.

In Step S6550, an image product of the image forming operation on the sheet of image receiving media may be output from the image forming system. Operation of the method proceeds to Step S6600, where operation of the method ceases.

The disclosed embodiments may include an exemplary method for media buffering and/or re-registration between multiple in-line media marking devices in an image forming system. FIG. 7 illustrates a flowchart of such an exemplary method. As shown in FIG. 7, operation of the method commences at Step S7000 and proceeds to Step S7050.

In Step S7050, a first sheet of image receiving media may be transported from a first single-side simplex marking device by which an image has been formed on a first surface of the first sheet of image receiving media to a duplex coupling module. Operation of the method proceeds to Step S7100.

In Step S7100, for single-side simplex image forming operations, the first sheet of image receiving media may be transported via a bypass path through the duplex coupling module directly to a first output portal. The first output portal may provide a transport mechanism by which a second downstream single-side simplex marking device may be bypassed. Operation of the method proceeds to Step S7150.

In Step S7150, for double-side duplex image forming operations, a leading edge and trailing edge of the first sheet of image receiving media may be sensed with an entrance sensor in the duplex coupling module. The sensing may facilitate analysis undertaken for timing control of the first sheet of image receiving media substrate in the duplex coupling module prior to being passed downstream to the second single-side simplex media marking device. Operation of the method proceeds to Step S7200.

In Step S7200, the first sheet of image receiving media may be diverted into an unoccupied one of a plurality of buffering bins in the duplex coupling module. Operation of the method proceeds to Step S7250.

In Step S7250, a leading edge and trailing edge of a second and subsequent sheet of image receiving media may be sensed with the entrance sensor in the duplex coupling module. This sensing may facilitate analysis undertaken for timing control of the second and subsequent sheet of image receiving media substrate in the duplex coupling module prior to being passed downstream to the second single-side simplex media marking device. Operation of the method proceeds to Step S7300.

In Step S7300, the second and subsequent sheet of image receiving media substrate may be diverted into other unoccupied ones of the plurality of buffering bins in the duplex coupling module. Operation of the method proceeds to Step S7350.

In Step S7350, a signal may be sent to the second downstream single-side simplex media marking device that the first sheet of image receiving media is ready to be fed to the second downstream single-side simplex media marking device. Operation of the method proceeds to Step S7400.

In Step S7400, based on signals exchanged between the duplex marking module and the second downstream single-side simplex media marking device, the first sheet of image receiving media may be released from the one of the plurality of buffering bins for further transport downstream in the duplex coupling module including to a registration/re-registration unit in the duplex coupling module. Operation of the method proceeds to Step S7450.

In Step S7450, registration/re-registration of the first sheet of image receiving media substrate may be executed in the registration/re-registration unit to register the first sheet of image receiving media appropriately as may be required by the second downstream single-side simplex media marking device. Operation of the method proceeds to Step S7500.

In Step S7500, the properly-timed and appropriately registered/re-registered first sheet of image receiving media may be passed downstream to the second single-side simplex media marking device. Operation method proceeds to Step S7550.

In Step S7550, a second surface of the first sheet of image receiving media may be marked in the second downstream single-side simplex media marking device. Operation of the method proceeds to Step S7600.

In Step S7600, the duplex marked first sheet of image receiving media may be output from the second downstream single-side simplex media marking device. Operation of the method proceeds to Step S7650.

In Step S7650, the signaling of the second downstream single-side simplex media marking module, the transporting of the first sheet of image receiving media to the registration/re-registration unit, the executing of the registration/re-registration, the passing of the properly timed and registered/reregistered first sheet of image receiving media to the second downstream single-side simplex media marking device, the marking of the second surface of the first sheet of image receiving media, and the outputting of the duplex marked first sheet of image receiving media may be repeated on the second and subsequent sheet of image receiving media until the image forming operation in the image forming system is completed. Operation of the method proceeds to Step S7700, where operation of the method ceases.

The above-described exemplary systems and methods reference certain conventional components to provide a brief, general description of suitable document processing and post-processing means by which to carry out the disclosed buffering and re-registration scheme between in-line simplex media marking devices for clarity and ease of understanding. Those skilled in the art will appreciate that other embodiments of the disclosed subject matter may be practiced with many types and configurations of individual devices and combinations of devices particularly common to image forming and post processing of image formed products in image forming devices of varying complexity. No limitation to the variety or configuration of individual component devices included in image forming systems of varying complexity is to be inferred from the above description.

The exemplary depicted sequences of executable instructions represent only examples of corresponding sequences of acts for implementing the functions described in the steps. The exemplary depicted steps in either or both of the above-described methods may be executed in any reasonable order to carry into effect the objectives of the disclosed embodiments. No particular order to the disclosed steps of the methods is necessarily implied by the depictions in FIGS. 6 and 7, and the accompanying description, except where a particular method step is a necessary precondition to execution of any other method step. Individual method steps may be carried out in sequence or in parallel in simultaneous or near simultaneous timing, as appropriate.

Although the above description may contain specific details, they should not be construed as limiting the claims in any way. Other configurations of the described embodiments of the disclosed systems and methods are part of the scope of this disclosure. For example, the above-described sensing and processing functions may be carried out by any form of sensor typically adapted for use in image forming systems and under the control of associated hardware circuits, software instructions, or firmware, as well as combinations thereof.

It will be appreciated that a variety of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

We claim:

1. A method for handling image receiving media in an image forming system, comprising:

providing a timing control device between a first in-line simplex media marking device and a second in-line simplex media marking device in the image forming system, the timing control device including a plurality of timing control; passages, each of the plurality of timing control passages comprising an inlet diverter gate, each inlet diverter gate being operable between a first position to divert the sheet of image receiving media into the respective timing control passage, and a second position to cause the sheet of image receiving media to bypass the respective timing control passage;

receiving, with a processor, instructions regarding a commanded image forming operation in the image forming system;

determining, with the processor, whether the commanded image forming operation is a simplex image forming operation or a duplex image forming operation;

when it is determined that the commanded image forming operation is a simplex image forming operation, operating the timing control device in a bypass mode that causes a first sheet of image receiving media imaged on a first side by the first in-line simplex media marking device to bypass the plurality of timing control passages in the timing control device; and when it is determined that the commanded image forming operation is a duplex image forming operation, operating the timing control device in a mode to divert a second sheet of image receiving media imaged on a first side by the first in-line simplex media marking device into an unoccupied one of the plurality of timing control-passages;

exchanging, with the processor, signals between the timing control device and the second in-line simplex media marking device to coordinate release of the second sheet of image receiving media for further processing in the second in-line simplex media marking device; and commanding, with the processor, releasing the second sheet of image receiving media from the one of the plurality of timing control passages in the timing control device for further processing in the second in-line simplex media marking device.

2. The method of claim 1, further comprising:

providing an image receiving media registration unit integrated in the timing control device;

receiving registration instructions for compatibility with the second in-line simplex media marking device; and registering the second sheet of image receiving media released from the one of the plurality of timing control passages according to the received registration instructions.

3. The method of claim 2, the image receiving media registration unit including at least one inlet registration sensor, the method further comprising:

determining, with the processor, based on information received from the at least one inlet registration sensor, a current registration condition of the second sheet of image receiving media;

comparing, with the processor, the current registration condition of the second sheet of image receiving media to the received registration instructions; and registering the second sheet of image receiving media based on the comparing.

4. The method of claim 2, the image receiving media registration unit comprising a translating electronic registration (TELER) system.

5. The method of claim 1, the operating the timing control device in the bypass mode comprising commanding, with the processor, the inlet diverter gate for each of the plurality of timing control passages to the second position to cause the first sheet of image receiving media to bypass all of the plurality of timing control passages and to be output from the timing control device without further processing.

6. The method of claim 1, each of the plurality of timing control passages having a timing control passage sensor to indicate the presence of the second sheet of image receiving media in a particular timing control passage, the method further comprising:

determining, with the processor, which of the plurality of timing control passages is unoccupied based on an input from the timing control passage sensor associated with the each of the timing control passages; and commanding, with the processor, the inlet diverter gate for a determined one of the plurality of timing control passages to the first position to cause the second sheet of image receiving media to be diverted into the determined one of the plurality of timing control passages.

7. The method of claim 6, further comprising generating, with the processor, a sheet-ready signal to be sent to the second in-line simplex media marking device based on the input from the timing control passage sensor.

8. An image forming system, comprising:

a first in-line simplex media marking device;

a sheet inverter positioned downstream of the first in-line simplex media marking-device in a process direction;

a timing control device positioned downstream of the first in-line simplex media marking device in a process direction in an image receiving media transport path including the first in-line simplex media marking device and the sheet inverter, the timing control device comprising a plurality of timing control passages, each of the plurality of timing control passages including:

at least one inlet end diverter gate that is usable to cause the sheet of image receiving media to be diverted into the each of the plurality of timing control passages, and at least one sensor for determining a presence of the sheet of image receiving media in the each of the plurality of timing control passages;

a second in-line simplex media marking device positioned downstream of the first in-line simplex media marking device, the sheet inverter and the timing control device in the process direction in an image receiving media transport path including the first in-line simplex media marking device, the sheet inverter and the timing control device; and a processor that is programmed to:

receive instructions regarding a commanded image forming operation in the image forming system;

determine whether the commanded image forming operation is a simplex image forming operation or a duplex image forming operation;

when it is determined that the commanded image forming operation is a simplex image forming operation, operate the timing control device in a bypass mode that causes a first sheet of image receiving media imaged on a first side by the first in-line simplex media marking device to bypass the plurality of timing control passages in the timing control device; and when it is determined that the commanded image forming operation is a duplex image forming operation, operate the timing control device in a timing control mode to divert a second sheet of image receiving media imaged on a first side by the first in-line simplex media marking device into one of the plurality of timing control passages by commanding positioning of the at least one inlet end diverter gate associated with the one of the plurality of timing control passages;

exchange signals between the timing control device and the second in-line simplex media marking device to coordinate release of the second sheet of image receiving media for further processing in the second in-line media marking device; and release the second sheet of image receiving media from the one of the plurality of timing control passages for the further processing.

9. The image forming system of claim 8, each at least one inlet end diverter gate being operable between a first position to divert the second sheet of image receiving media into a respective one of the timing control passages, and a second position to cause the first sheet of image receiving media to bypass the respective one of the timing control passages.

10. The image forming system of claim 9, the processor being further programmed, when it is determined that the commanded image forming operation is the simplex image forming operation, to command the at least one inlet end diverter gate for each of the plurality of timing control passages to the second position to cause the first sheet of image receiving media to bypass all of the plurality of timing control passages and to be output from the timing control device without further processing.

11. The image forming system of claim 9, the processor being further programmed, when it is determined that the commanded image forming operation is the duplex image forming operation, to:

determine which of the plurality of timing control passages is unoccupied based on an input from at least one sensor for determining a presence of the second sheet of image receiving media in the each of the plurality of timing control passages; and command the at least one inlet end diverter gate for the determined one of the plurality of timing control passages to the first position to cause the second sheet of image receiving media to be diverted into the determined one of the plurality of timing control passages.

12. The image forming system of claim 11, the processor being further programmed to generate a sheet-ready signal to send to the downstream simplex media marking device based on the input from a timing control passage sensor.

13. The image forming system of claim 8, further comprising an image receiving media registration unit integrated into the timing control device for registering the second sheet of image receiving media downstream of the first in-line simplex media marking device and upstream of the second and-line simplex media marking device in the process direction to be compatible with input requirements for the second in-line simplex media marking device, the processor being further programmed to:

receive registration instructions for compatibility with the input requirements for the second in-line simplex media marking device; and control the image receiving media registration unit to register the second sheet of image receiving media released from the one of the plurality of timing control passages according to the received registration instructions.

14. The image forming system of claim 13, the image receiving media registration unit including at least one inlet registration sensor that determines a current registration condition of the second sheet of image receiving media, the processor being further programmed to:

compare the current registration condition of the second sheet of image receiving media to the received registration instructions; and control the image receiving media registration unit to register the second sheet of image receiving media based on the comparison.

15. The image forming system of claim 13, the image receiving media registration unit comprising a translating electronic registration (TELER) system.

* * * * *